United States Patent [19]

Peterson

[11] 3,934,115

[45] Jan. 20, 1976

[54] METHOD AND APPARATUS FOR ELECTRIC SINGE CUTTING

[76] Inventor: Gerald H. Peterson, 650 Bush, San Francisco, Calif. 94108

[22] Filed: Sept. 25, 1973

[21] Appl. No.: 400,595

[52] U.S. Cl. ..... 219/223; 8/161; 30/32; 30/140; 83/171; 128/303.14; 132/7; 219/233

[51] Int. Cl.[2] ..... H05B 3/02; B26D 7/10

[58] Field of Search ..... 8/94.16, 161; 30/32, 34 R, 30/140; 19/2; 128/303, 303.14, 303.15, 303.16; 69/20; 132/7; 83/15, 16, 170, 171; 219/221, 223, 233, 384, 383

[56] References Cited

UNITED STATES PATENTS

| | | | |
|---|---|---|---|
| 2,231,219 | 2/1941 | Peterson | 219/223 |
| 2,421,125 | 5/1947 | Krebs | 30/140 |
| 2,564,126 | 8/1951 | Neece | 219/223 |
| 2,777,041 | 1/1957 | Dustman | 219/10.79 |
| 2,966,572 | 12/1960 | Hobbs | 219/223 |
| 3,197,612 | 7/1965 | Reich | 219/223 |
| 3,237,489 | 3/1966 | Trethewey et al. | 219/233 UX |
| 3,614,382 | 10/1971 | Politzer | 219/223 |

*Primary Examiner*—A. Bartis
*Attorney, Agent, or Firm*—Browne, Beveridge, DeGrandi & Kline

[57] ABSTRACT

Thin material such as hair or paper is severed by a singeing process using the heated and opposed edges of two thin strips of metal with the edges closely spaced apart to form a slot and with the edges heated by high frequency electrical current or currents flowing along such strips and exhibiting therewith and therebetween skin and proximity effects, and by moving such strips relative to such material so that the material to be singed or severed enters such slot and is therein singed to effect severance by such singeing.

5 Claims, 4 Drawing Figures

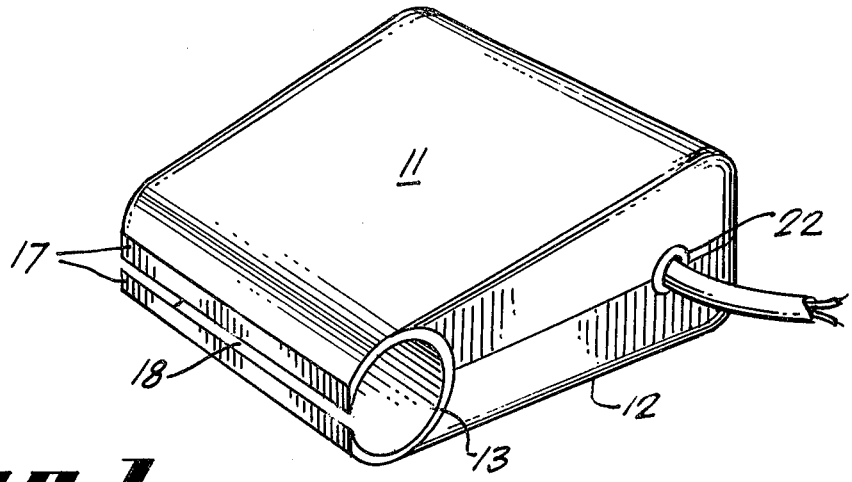
Fig. 1
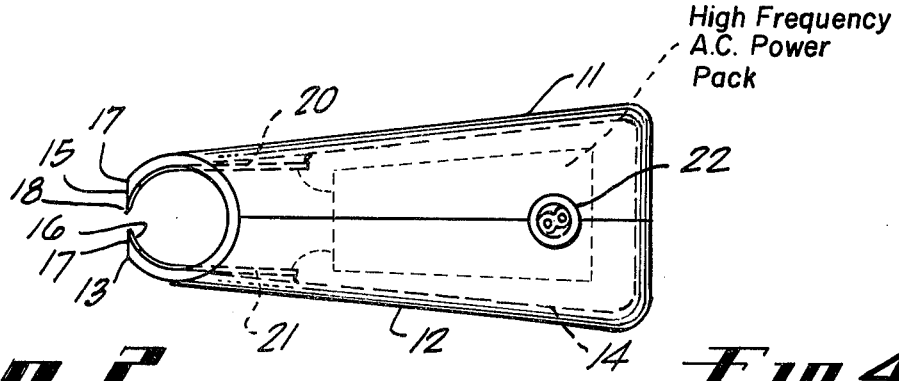
Fig. 2
Fig. 4
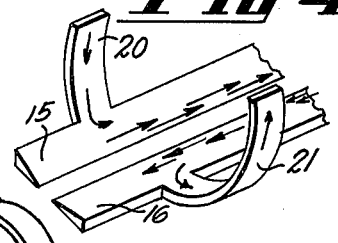
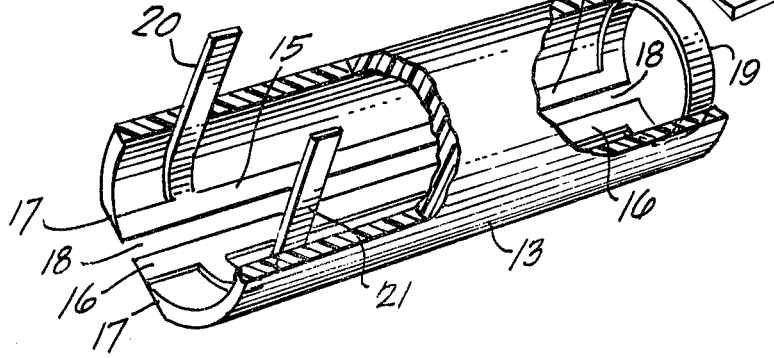
Fig. 3
INVENTOR.
Gerald H. Peterson

METHOD AND APPARATUS FOR ELECTRIC SINGE CUTTING

FIELD OF THE INVENTION

This device is a singeing cutter that singes thin material, such as hair, close to the skin, or paper.

DESCRIPTION OF THE PRIOR ART

It is well known to singe hair or feathers to remove them from skin. However, no process is known or device known that controls the application of heat to effect singeing of hair where the zone of application of such heat can be limited to a small and precise line, and, yet, very close to the skin, which prevents burning or blistering of the live skin supporting such hair, and to effect such singeing close enough to the skin to be acceptable in comparison with the other type razors now available. It is also known to shear paper or other thin material.

The razor disclosed by Reich, U.S. Pat. No. 3,197,612, July 27, 1965 employs high frequency to heat and singes hair coming into such field.

The razor disclosed by Hills, U.S. Pat. No. 2,727,132, Dec. 13, 1955 employs a single hot wire to singe hair brought into contact therewith.

Neither of these prior devices discloses an apparatus in which the singeing zone can be brought close enough to the skin to achieve a shave comparable to that of the mechanical cutters now available.

It is an object of the present invention to devise a razor that may be used for severing hair from live skin by singeing such hair close to the skin in a manner comparable to the shaving closeness of present shear type mechanical razors, or for severing other thin material by singeing.

It is a further object of the present invention to devise a singer razor in which the heat to effect singeing of hair from live skin is generated by the use of high frequency currents evidencing skin and proximity effects.

Further, it is an object of the invention to devise a razor having therein a sharp-edged narrow slot that has such edges heated and insulated thereadjacent.

SUMMARY OF THE INVENTION

One embodiment of the present invention is had by the use of a short length of cylindrical tubular ceramic material of very low thermal conductivity; by forming such tube with a flat chordal face that intersects the inner surface of the tube enough to form a narrow slot the length of the tube; by plating on or adhering to the tube, along each opposed edge of such slot, a very narrow strip of electrically conductive metal; and by passing along each such very narrow strip a current of such high frequency that it will exhibit skin effect and, in addition, the electron current in one strip will be at any instant in opposite direction of travel to that in the other so that, as between the two strips, the currents will exhibit the proximity effect to cause such currents to concentrate in and heat the opposed edges of said strips across such slot. When material such as hair or paper enters such slot, the heat from such edges singes the material between such edges. It is to be noted that such heating is confined to a very small slot containing the very narrow edges of such strips.

BRIEF DESCRIPTION OF THE DRAWINGS

The above outline of an embodiment of the invention is hereinafter described in detail and illustrated in the drawings herewith, in which:

FIG. 1 is a perspective view of a razor embodying the present invention.

FIG. 2 is a side view of the razor.

FIG. 3 is a perspective view of the ceramic head of the razor with parts broken away.

FIG. 4 is a partial expanded view of FIG. 3 showing the opposed current-conducting strips.

DESCRIPTION OF THE PREFERRED EMBODIMENT

The razor of the present invention has four principle sub-assembly parts that are shown in the illustrations of FIGS. 1 and 2. These parts are two casing halves 11 and 12 that clamp together to retain therebetween along one edge thereof a ceramic sleeve 13. Inside of the main portions of the clamped together casing halves is a power pack 14 for supplying a particular quality current to two very narrow strips of metal 15 and 16 inside of the sleeve 13 and in current series with such power pack.

The ceramic sleeve is open ended and is flattened outwardly of such casing in a chordal plane 17 parallel to the axis of the sleeve and to a depth that will open and form a narrow slot 18 through the wall of the sleeve. This slot is only wide enough to allow the easy ingress of hair or like thin material between the opposed edges thereof and preferably as small as possible and yet permit the hair to enter therein. There is adhered to the inside surface of the sleeve the narrow strip of electrically conductive metal 15 and 16 parallel to and one at the side of each edge of the slot. These strips are very thin and need not be more than a cover of plating on the ceramic. They are also preferably very narrow. An edge of each of the strips is coextensive with the sharp ceramic edge of the slot except that the ends of the strips are in a short distance from the ends of the slot. Adjacent one end of the slot, a connector 19 electrically connects the adjacent ends of the strips by passing from one to the other circularly around the inside of the sleeve. Adjacent the other end of the slot each of the strips is in electrical conductivity with a separate conductive leads 20 and 21 that extend upward through a separate hole in the sleeve and into the power pack where each of the leads is suitably connected into the circuitry of the power pack.

The power pack receives external electrical power through a connector in the opening 22 of the case near the end away from the ceramic sleeve. When suitable power is delivered to the power pack it transforms the power to high frequency alternating current, about 100 kc to 500 kc. The criteria is that the current flowing in the circuit including the edge to edge strips 15 and 16 is of a frequency that will cause it to flow with greater density adjacent the surfaces of the conductors, including the strips 15 and 16 than axially thereof, the skin effect, and it will further concentrate in the portions of the strips 15 and 16 that are close together and opposed to each other across the slot 18, by having the two currents such that the electrons travel in opposite directions at any and all instants of time causing the proximity effect. The value of the current is such that this concentration of the current in the opposed edges will heat these edges, with concentration on the faces of the edges, to the required temperature, that will cause hair or other thin material entering the slot to be singed and severed in the narrow line area between the opposed edges of the strips 15 and 16. This singeing should be of a degree that will sever the thin material.

There are several advantages to the particular construction. Among these are, first, the use of the ceramic sleeve provides a skin contacting surface that can be smooth, free of corrosion, small enough to conform to the curves of a person's skin, and provides high resistance to heat and high electrical resistance. Second, putting the strips 15 and 16 on the inside of the sleeve allows the ceramic sleeve to insulate the skin being shaved from the hot metal strips 15 and 16 and allows the strips 15 and 16 to be rigidly mounted throughout their lengths. Third, the sharp edges of the ceramic along the edges of the slot 18 allow the hot edges of the strips to be close to the skin so as to singe the hair close to the skin. And, fourth, the device has no moving mechanical parts to vibrate, wear, and cause frictional losses, and the heat loss of the power pack and the singeing strips 15 and 16 will probably, in most embodiments of the invention, be less than the motor losses in motor driven mechanical razors, or shavers.

Connecting the two strips 15 and 16 in series in the circuit has the necessary characteristics mentioned above of achieving the proximity effect. This characteristic is that, at any instant of current flow, the electrons of the current in one of the opposed strips 15 and 16 must have a direction of travel in opposition at any instant to the travel of the current in the other strip to exhibit the proximity effect.

This proximity effect may be achieved by placing the parallel closely spaced conductors in series in a circuit as above disclosed or they may be placed in parallel separate circuits as disclosed in my U.S. Pat. No. 3,004,136, Oct. 10, 1961.

While the preferred embodiment of the invention shows its application to the severence of hair, other material such as a thin paper sheet may be severed along a line by placing it between the described and functioning opposed metal edges, or by moving it between such edges longitudinally thereof.

Having thus described an embodiment of my invention, its construction and operation, I claim:

1. The method of severing a thin material by the application of sufficient heat along a line on each of the opposite sides of said material in back-to-back relationship to sever such material along a line, that comprises inserting said material between two elongated, closely spaced strip electrical conductors, each having in opposition to the other a narrow edge, causing to travel along each of said conductors a high frequency current exhibiting in such travel the skin effect, and said edges of said conductors being sufficiently close enough together and the electron travel of each said currents being opposite one another at any instant such that the currents in said conductors exhibit the proximity effect whereby the current in each conductor is concentrated in the face of the edge of each conductor to heat the edges to the severing temperature for the material, and whereby said inserted material will be severed along such line by the heat generated along and between such opposed narrow edges.

2. A singer cutter comprising: a pair of elongated, closely spaced narrow metallic strips, means for supporting said strips in spaced relation so that parallel opposed edges of will form therebetween a narrow, elongated slot, a source of high frequency current, means connected to each strip for passing high frequency current along each said strip, means electrically connecting said strips and arranged so as to cause said current to flow in a direction in one said strip opposite to that in the other said strip at any instant, said currents being of a sufficient frequency to exhibit a skin effect and said edges being sufficiently close together to exhibit a proximity effect therebetween so as to concentrate said currents in the opposed edges of such slot to heat said edges to the severing temperature of a material to be cut between said edges.

3. In the combination of claim 2, said means supporting said strips in spaced relation comprising an interior and an exterior and being formed of a low thermal conductivity material, said strips being coextensive with said low thermal conductivity material and adhering thereto.

4. The combination of claim 3 in which said means for supporting said strips is in the form of a cylindrical sleeve formed with an axially extending sharp edged slot coextensive with and adjacent to the slot formed by said strips.

5. The combination of claim 4 in which said sleeve slot is formed by a plane parallel to the axis of said sleeve.

* * * * *